US010458054B1

(12) United States Patent
Hamilton

(10) Patent No.: US 10,458,054 B1
(45) Date of Patent: Oct. 29, 2019

(54) COMBINATION WASHING AND DRYING APPARATUS

(71) Applicant: Frederick Hamilton, Pelham, AL (US)

(72) Inventor: Frederick Hamilton, Pelham, AL (US)

( * ) Notice: Subject to any disclaimer, the term of this patent is extended or adjusted under 35 U.S.C. 154(b) by 0 days.

(21) Appl. No.: 16/169,009

(22) Filed: Oct. 24, 2018

(51) Int. Cl.
*D06F 29/00* (2006.01)
*D06F 31/00* (2006.01)

(52) U.S. Cl.
CPC ..... *D06F 29/005* (2013.01); *D06F 29/00* (2013.01); *D06F 31/00* (2013.01)

(58) Field of Classification Search
CPC ..... D06F 29/00; D06F 29/005; D06F 95/00
See application file for complete search history.

(56) References Cited

U.S. PATENT DOCUMENTS 3,185,286 A * 5/1965 Koplin ..... D06B 3/30 198/434
6,151,795 A * 11/2000 Hoffman ..... D06F 58/12 34/605
6,588,238 B1 * 7/2003 Reason ..... D06F 37/04 68/142
6,671,978 B1 * 1/2004 McGowan ..... D06F 29/00 34/527
6,725,563 B1 * 4/2004 Miyamoto ..... D06F 58/20 34/127
6,978,556 B1 12/2005 Cornelious
7,370,765 B1 * 5/2008 Ellenberger ..... B07C 5/3412 209/587
7,404,303 B1 * 7/2008 Barbosa ..... D06F 29/00 68/19.2
8,813,287 B2 * 8/2014 Saubert ..... D06F 29/005 8/158
9,617,675 B2 4/2017 Saubert
2002/0069465 A1 * 6/2002 Chute ..... D06F 58/203 8/158
2007/0169519 A1 * 7/2007 Hershey ..... D06F 29/00 68/3 R (Continued)

FOREIGN PATENT DOCUMENTS

CN 202967440 U * 6/2013

OTHER PUBLICATIONS

Machine translation of CN 202967440 U to Qian et al., published Jun. 2013. (Year: 2013).*

*Primary Examiner* — Joseph L. Perrin
(74) *Attorney, Agent, or Firm* — Dale J. Ream

(57) ABSTRACT

A combination washing and drying apparatus includes a housing defining a singular interior area. A washing assembly positioned in the housing includes a washer drum having a first and second concentric washer sleeves movable between a closed configuration at which a bottom opening defined by the first washer sleeve is blocked by the second washer sleeve and an open configuration in which the bottom opening is not blocked for releasing the clothing from the first washer sleeve. A drying assembly is positioned in the housing and includes a dryer drum having first and second concentrically aligned dryer sleeves defining a side opening and being movable between a closed configuration blocking the side opening and an open configuration allowing the clothing to be inserted into the dryer drum. A conveyor assembly includes a continuous belt operably movable when energized for conveying the clothing between the washing and drying assemblies.

3 Claims, 9 Drawing Sheets

(56) References Cited

U.S. PATENT DOCUMENTS

| | | | | |
|---|---|---|---|---|
| 2014/0318191 | A1 | 10/2014 | Lorick | |
| 2018/0142393 | A1* | 5/2018 | Harris | D06F 29/005 |
| 2018/0209084 | A1* | 7/2018 | Chakravarty | D06F 33/02 |

* cited by examiner

COMBINATION WASHING AND DRYING APPARATUS

BACKGROUND OF THE INVENTION

This invention relates generally to washing and drying machines and, more particularly, to a combination washing and drying apparatus having a washing assembly and drying assembly positioned within a unitary housing and are connected by a continuous belt and operable to wash a load of laundry, transfer the washed laundry via the continuous belt to the drying apparatus, and drying the transferred laundry—all actuated and coordinated by the press of a single actuation button.

The act of "doing laundry" or washing a quantity of clothing is a household chore that has been carried out for centuries in one way or another. In modern times, doing laundry typically means manually inserting a load of soiled clothing into a dedicated washing machine and activating (energizing) the washing machine to conduct a wash cycle. When washing is complete—often indicated by the sounding of a buzzer or electronic alarm—the wet clothing must be manually removed from the washer, inserted into a dedicated drying machine and a drying cycle activated. Only after this time consuming two-stage process is the laundry ready to be removed and folded or otherwise stowed for future use.

Various devices have been proposed in the art for a combined washing and drying system that eliminates the traditional two-stage process of washing and dying laundry, such as the machines shown in U.S. Pat. No. 6,978,556 to Cornellious and others. Although presumably effective for their intended purposes, the existing devices and proposals are not as efficient or suitable for one-stage washing and drying as the present invention as disclosed below.

Therefore, it would be desirable to have a combination washing and drying apparatus for washing and then drying a load of clothing at the touch of a single activation button. Further, it would be desirable to have a combination washing and drying apparatus in which the washing and drying drums include first and second concentric sleeves operable for simultaneously opening and closing in conjunction with operation of a continuous belt, whereby to receive and delivery a load of laundry between washing and drying assemblies.

SUMMARY OF THE INVENTION

A combination washing and drying apparatus for washing and then drying a load of clothing according to the present invention includes a housing having a plurality of upstanding walls extending between opposed bottom and top walls has a unitary construction defining an interior area. A washing assembly is positioned in the interior area of the housing and includes a washer drum having a first washer sleeve that has a cylindrical configuration and a second washer sleeve positioned concentrically in the first washer sleeve and movable between a closed configuration at which the bottom opening and the washer aperture are offset such that the bottom opening is blocked by the second washer sleeve and an open configuration in which the bottom opening are aligned for releasing the clothing from the first washer sleeve.

Similarly, a drying assembly is positioned in the interior area of the housing and includes a dryer drum having a first dryer sleeve that has a cylindrical configuration defining an interior space for receiving the clothing and a side opening and having a second dryer sleeve positioned concentrically in the first dryer sleeve and movable between a closed configuration at which side opening is blocked by the second dryer sleeve and an open configuration in which the side opening is not blocked and allows the clothing to be inserted into the dryer drum. A conveyor assembly includes a continuous belt operably movable when energized for conveying the clothing between the washing and drying assemblies.

Therefore, a general object of this invention is to provide a combination washing and drying apparatus for washing and then drying a load of clothing at the touch of a single activation button.

Another object of this invention is to provide a combination washing and drying apparatus, as aforesaid, in which a washing assembly and drying assembly are situated inside a singular housing and being operably connected by a conveyor assembly.

Still another object of this invention is to provide a combination washing and drying apparatus, as aforesaid, in which the washer assembly includes a washer drum having first and second concentric sleeves that are movable between a closed configuration blocking laundry within the washer drum from a bottom opening and an open configuration allowing laundry to fall via gravity from the washer drum onto the conveyor assembly.

Yet another object of this invention is to provide a combination washing and drying apparatus, as aforesaid, in which the dryer assembly includes a dryer drum having first and second concentric sleeves that are movable between a closed configuration blocking laundry from being received into the dryer via a side opening and an open configuration allowing laundry to be received from the conveyor assembly into the dryer drum through the side opening.

A further object of this invention is to provide a combination washing and drying apparatus, as aforesaid, in which the washing assembly, drying assembly, and conveyor assembly are in electrical and data communication with the actuation button via a controller or similar electronics.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
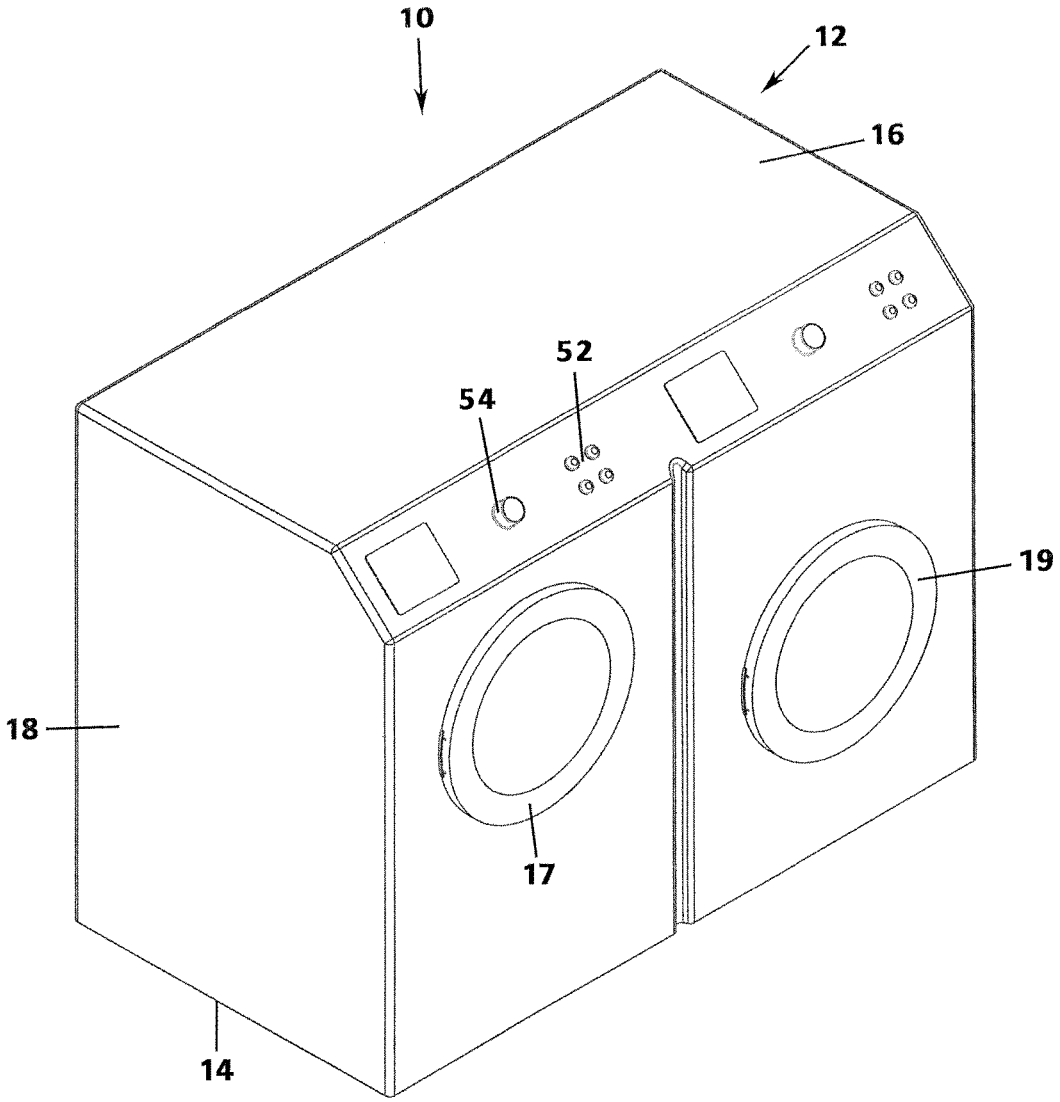
FIG. 1 is a perspective view of a washing and drying apparatus according to a preferred embodiment of the present invention, illustrated with washer and dryer access doors in closed configurations.
Figure 2:
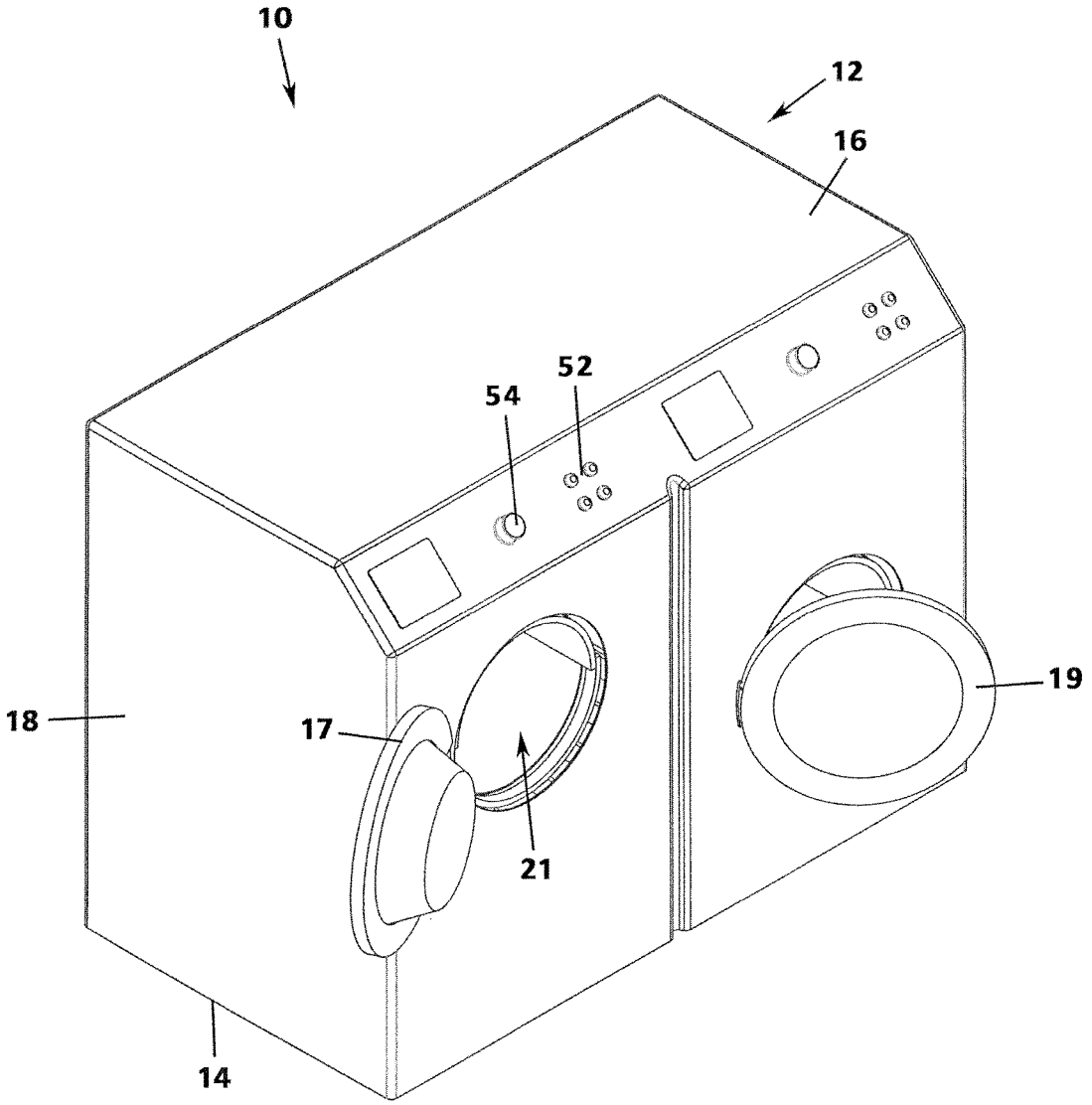
FIG. 2 is another perspective view of the washing and drying apparatus as in FIG. 1, illustrated with washer and dryer access doors in open configurations.
Figure 3:
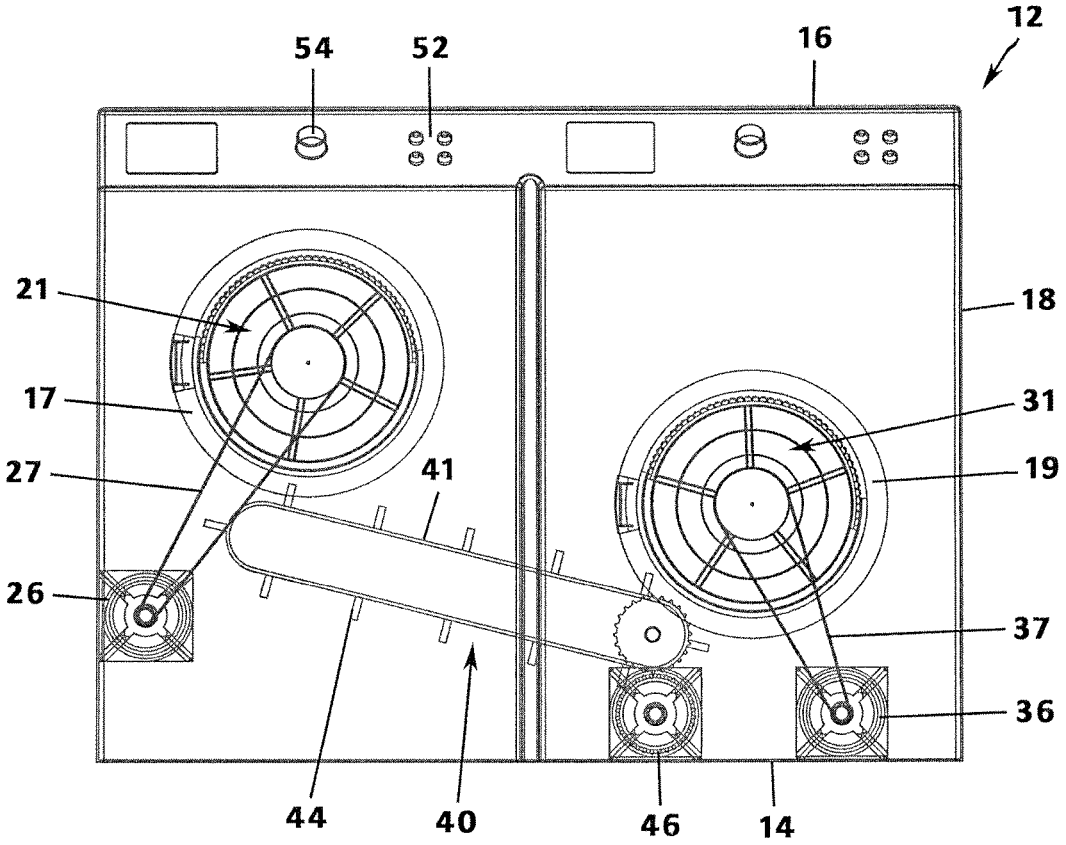
FIG. 3 is a front view of the washing and drying apparatus as in FIG. 1, illustrated with a front wall removed to show the internal components of the apparatus.
Figure 4:
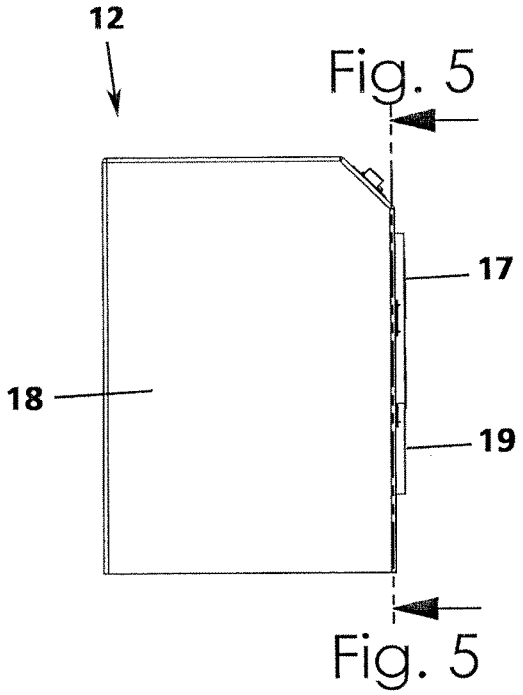
FIG. 4 is a side view of the washing and drying apparatus as in FIG. 3.
Figure 5:
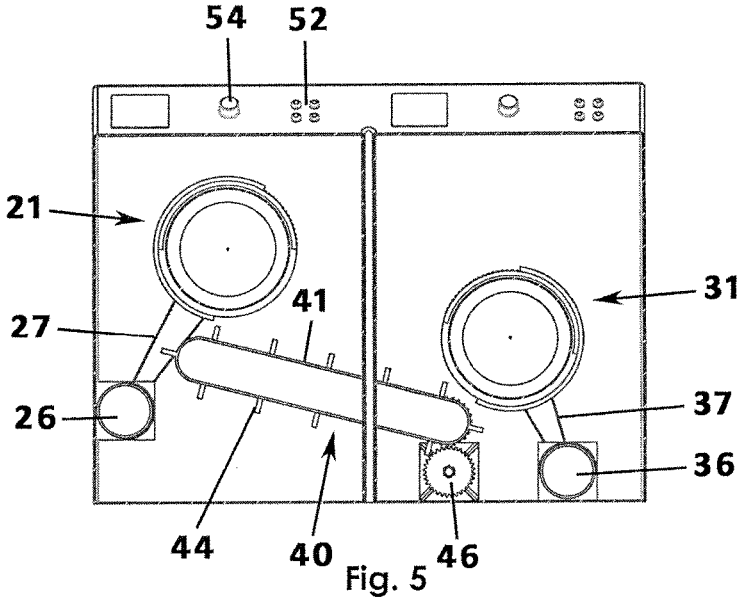
FIG. 5 is a sectional view taken along line 5-5 of FIG. 4.

A combination washing and drying apparatus according to the present invention will now be described in detail with reference to FIGS. 1 to 10 of the accompanying drawings. The combination washing and drying apparatus 10 includes a housing 12, a washing assembly 20, a drying assembly 30, and a conveyor assembly 40 for moving laundered clothing between the washing assembly 20 and drying assembly 30.

The housing 12 is configured to contain all of the assemblies of the apparatus 10 so that washing and drying cycles may be carried out automatically and without human interaction. More particularly, the housing 12 includes a bottom wall 14, a top wall 16 that is upwardly displaced from and generally parallel to the bottom wall 14, and a plurality of upstanding walls 18 extending between peripheral edges of the bottom wall 14 and top wall 16. The upstanding walls 18 may include opposed side walls, a back wall, and one or more front walls.

The washing assembly 20 includes a washer drum 21 that is operable to rotate and wash clothing placed therein and when energized to rotate. It is understood that the washer drum 21 may include inlet and outlet ports for receiving and draining water although the water connections are not shown in the drawings and are not specifically pertinent to the present invention and are known in the art of washing machines. Similarly, the plumbing details of injecting laundry soap, drum rotations, rinse cycles, and the like are presumed to be included in the present invention but are not shown with particularity as such manufacturing detail is presumed and known in the art. A washer motor 26, washer belt 27, and related washer hardware may be operably coupled to the washer drum 21 for operating the washer drum 21 to carry out a wash cycle when energized.

The washer drum 21 has a generally cylindrical configuration defining an interior space and that is open on a front side for receiving clothing to be laundered into the interior space. Further, a washer access door 17 is pivotally coupled to a front wall of the housing 12 adjacent the open front side of the washer drum 21 that, when opened, allows clothing intended to be washed to be manually inserted (e.g. by a person) into the washer drum 21. The washer drum 21 includes a closed back side 28.

By contrast to the details of how a washer drum functions to clean clothing, the detailed description of the structure of the washer drum 21 itself is critical to the novel functions of the present invention and will be described below. Preferably, the washer drum 21 includes a first washer sleeve 22 and a second washer sleeve 24 concentrically mounted inside the first washer sleeve 22, the second washer sleeve 24 being slidably rotatable with respect to the first washer sleeve 22. For instance, the first washer sleeve 22 may include grooves or rails and the second washer sleeve 24 may include one or more flanges and be powered by a servo-motor (not shown) or the like to rotate relative to the first washer sleeve when energized.

Figure 6:
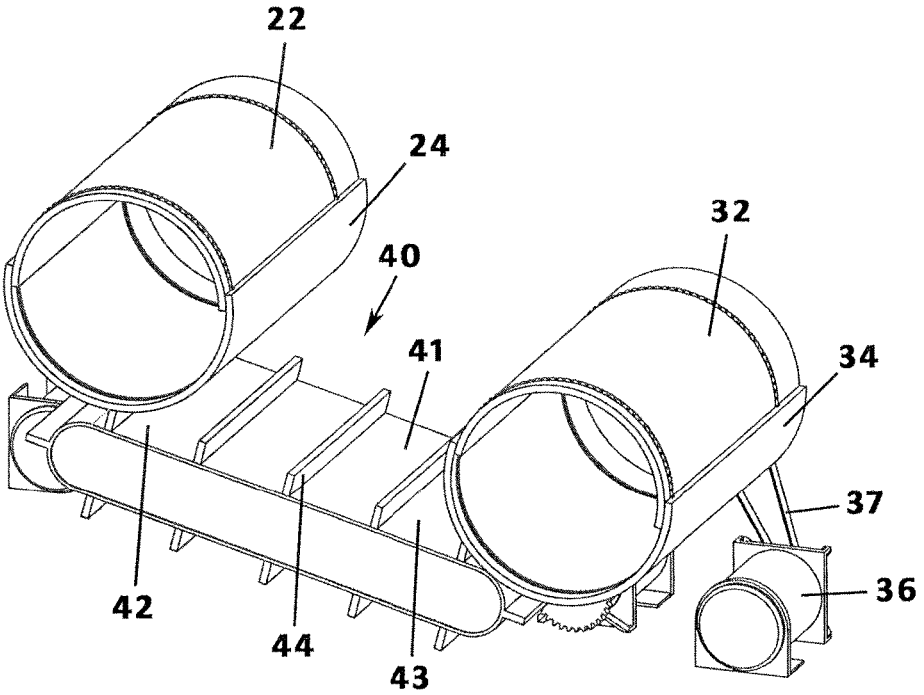
FIG. 6 is a perspective view on an enlarged scale of the washing, drying, and conveyor assemblies according to the present invention and removed from the housing, illustrated in closed configurations, respectively.
Figure 7:
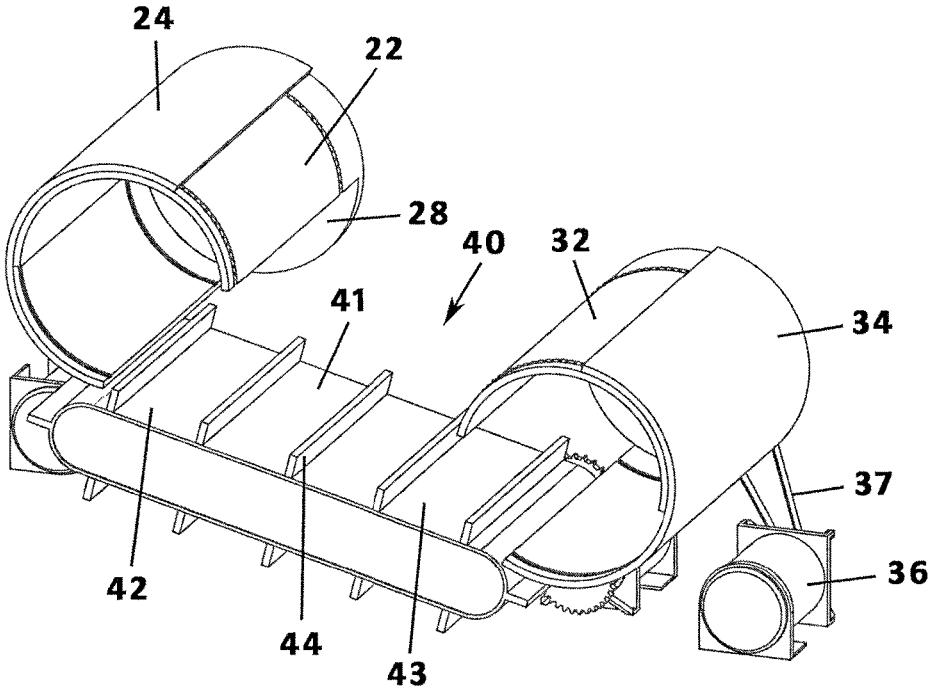
FIG. 7 is a perspective view on an enlarged scale of the washing, drying, and conveyor assemblies according to the present invention and removed from the housing, illustrated in open configurations, respectively.
Figure 8A:
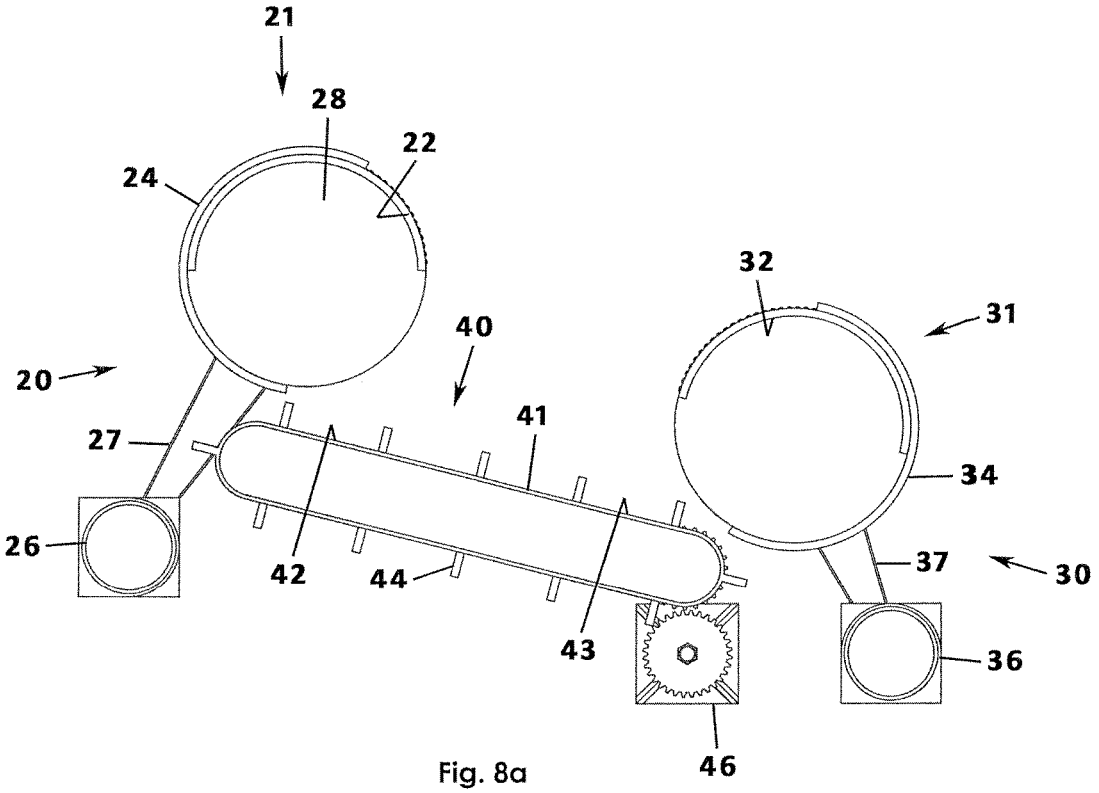
FIG. 8*a* is a side view of the washing, drying, and conveyor assemblies as in FIG. 7.
Figure 8B:
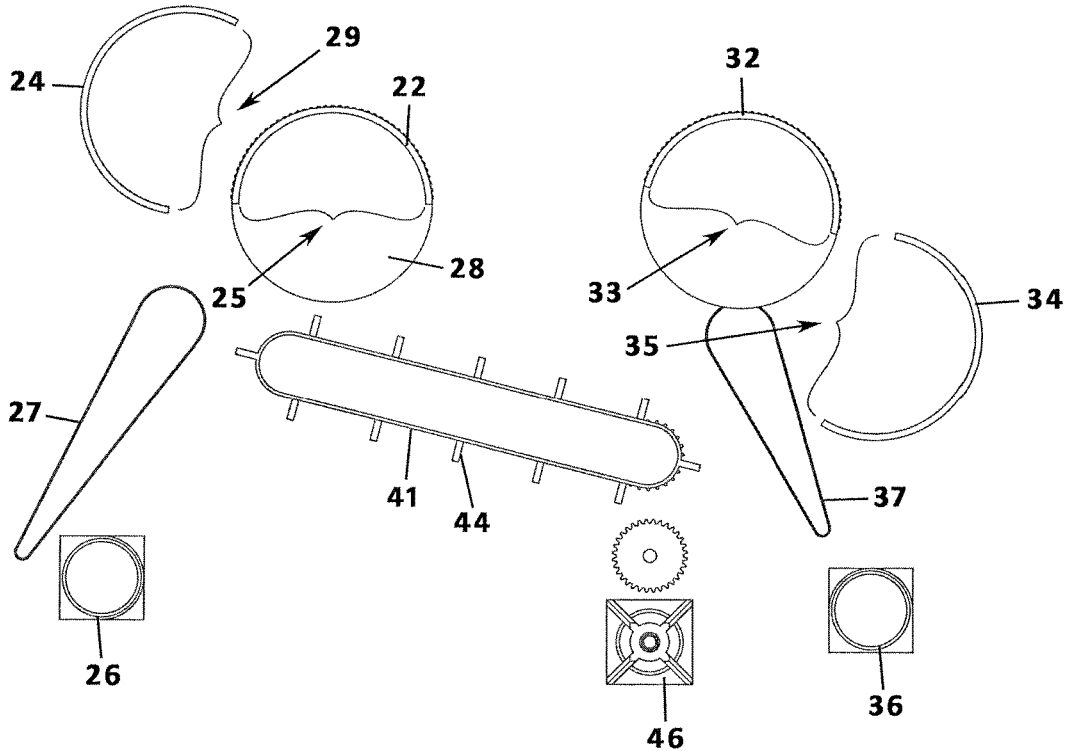
FIG. 8*b* is an exploded view of the apparatus shown in FIG. 8*a;*
Figure 9:
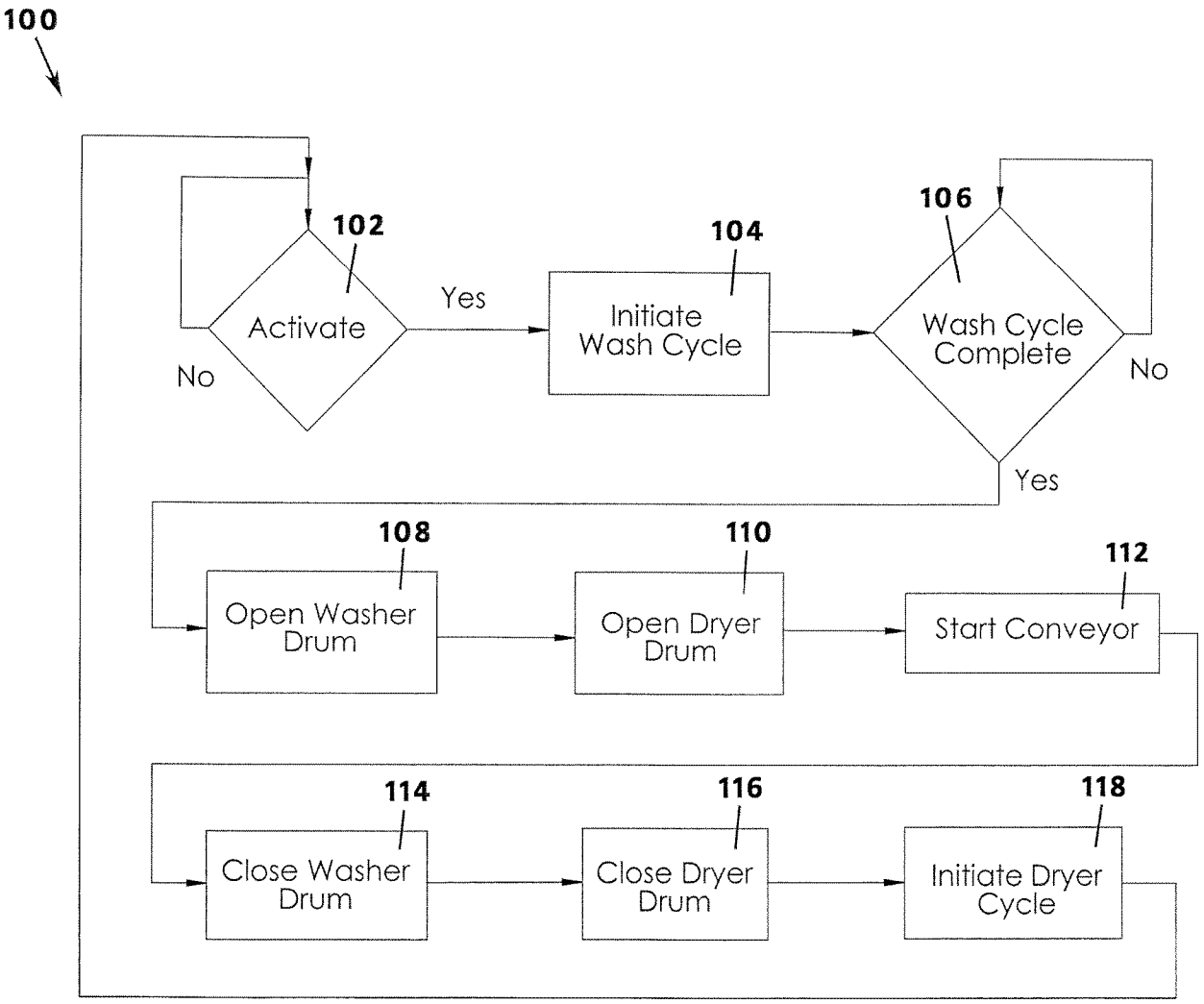
FIG. 9 is a flowchart illustrating an exemplary process of operation of the washing and drying apparatus according to the present invention.

As best shown in FIGS. 6 to 8, the first washer sleeve 22 may include a cylindrical configuration having a bottom opening 25. In this respect, the first washer sleeve 22 may be referred to as having a frusto-cylindrical configuration or a partial cylindrical configuration. Preferably, the first washer sleeve 22 has a circular geometric segment of greater than 180 degrees and, preferably, about 270 degrees so as to define the bottom opening 25. The bottom opening 25 defined by the first washer sleeve 22 is oriented downwardly, i.e. facing generally toward the bottom wall 14 or, as will be discussed later, adjacent a continuous belt 41 of the conveyor assembly 40. Similarly, the second washer sleeve 24 may include a configuration complementary and substantially similar to a configuration of the first washer sleeve 22 except that the second washer sleeve 24 has a slightly larger diameter than a diameter of the first washer sleeve 22 so that the second washer sleeve 24 is positioned concentrically outside the first washer sleeve 22 for slidable rotation thereabout (such as via a rail/channel construction or the like). It is understood that which washer sleeve is positioned to the interior or exterior of the other would be a matter of design choice. Again, the second washer sleeve 24 is not a full cylinder and the void of the incomplete cylinder may be referred to as a washer side aperture 29. Further, the second washer sleeve 24 need only have a length longer than a length of the bottom opening 25 so that the second washer sleeve 24 is movable between a closed configuration that covers or blocks the bottom opening (FIG. 6) and an open configuration displaced from the bottom opening 25 that allows access between the interior space of the washer drum 21 and the area outside the washer drum 21, i.e. allows laundry to fall by force of gravity from the washer drum 21 onto the continuous belt 41 of the conveyer assembly 40 as will be described later. Stated another way, the bottom opening 25 and washer side aperture 29 are offset (not aligned) at the closed configuration but, by contrast, are aligned to form an opening at the open configuration.

Similarly, the drying assembly 30 includes a first dryer sleeve 32 and a second dryer sleeve 34 concentrically mounted inside the first dryer sleeve 32, the second dryer sleeve 34 being slidably rotatable with respect to the first dryer sleeve 32. For instance, the first dryer sleeve 32 may include grooves or rails and the second dryer sleeve 34 may include one or more flanges and be powered by a servo-motor (not shown) or the like to rotate relative to the first dryer sleeve when energized.

As best shown in FIGS. 6 to 8, the first dryer sleeve 32 may include a cylindrical configuration having a side opening 33. In this respect, the first dryer sleeve 32 may be referred to as having a frusto-cylindrical configuration or a partial cylindrical configuration. Preferably, the first dryer sleeve 32 has a circular geometric segment of about 180 degrees and, preferably, about 270 degrees so as to define the side opening 33. The side opening 33 defined by the first dryer sleeve 32 is oriented toward a left side, i.e. facing generally toward the downstream end of a continuous belt 41 of the conveyor assembly 40. Similarly, the second dryer sleeve 34 may include a configuration complementary and substantially similar to a configuration of the first dryer sleeve 32 except that the second dryer sleeve 34 has a slightly larger diameter than a diameter of the first dryer sleeve 32 so that the second dryer sleeve 34 is positioned concentrically outside the first dryer sleeve 32 for slidable rotation thereabout. It is understood that which dryer sleeve is positioned to the interior or exterior of the other would be a matter of design choice. Again, the second dryer sleeve 34 is not a full cylinder and the void of the incomplete cylinder may be referred to as a dryer side aperture 35. Further, the second dryer sleeve 34 need only have a length longer than a length of the side opening 33 so that the second dryer sleeve 34 is movable between a closed configuration that covers or blocks the side opening 33 (FIG. 6) and an open configuration displaced from the side opening 33 that allows access between the interior space of the dryer drum 31 and the area outside the washer drum 21, i.e. allows laundry to be deposited into the interior space of the dryer drum 31 (FIG. 7) by movement of the continuous belt 41 as will be described later. Stated another way, the side opening 33 and dryer side aperture 35 are offset (not aligned) at the closed configuration but, by contrast, are aligned to form an opening at the open configuration. A dryer motor 36, dryer belt 37, and related dryer hardware may be operably coupled to the dryer drum 31 for operating the dryer drum 31 to carry out a dryer cycle when energized.

In a related aspect, the washing assembly 20 includes a washer access door 17 pivotally coupled to the washer drum 21 that is pivotally movable between a closed configuration that blocks access to the interior spaced of the washer drum 21 and an open configuration that allows access to the washer drum 21. Specifically, the front side of the washer drum 21 is open and the housing 12 defines a complementary opening and the washer access door 17 blocks or allows access through respective opening. Similarly, the drying assembly 30 includes a dryer access door 19 pivotally coupled to the dryer drum 31 that is pivotally movable between a closed configuration that blocks access to the interior spaced of the dryer drum 31 and an open configuration that allows access to the dryer drum 31. Specifically, the front side of the dryer drum 31 is open and the housing 12 defines a complementary opening and the dryer access door 19 blocks or allows access through respective opening.

Figure 10:
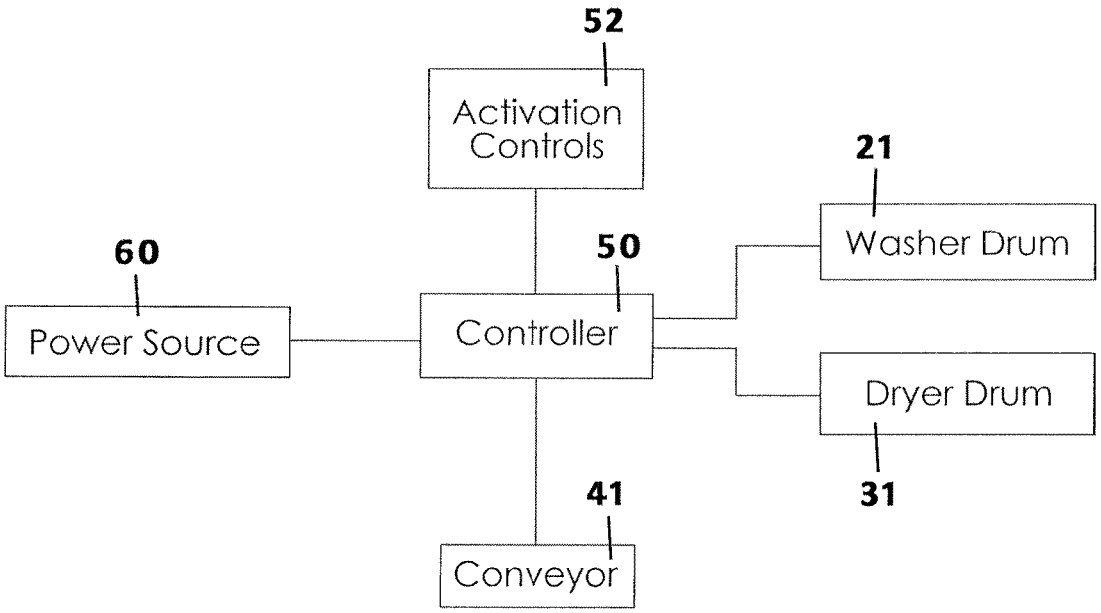
FIG. 10 is a block diagram illustrating the electric and electronic components of the present invention.

In another aspect, the conveyor assembly 40 is capable of transporting laundry from the washer drum 21 to the dryer drum 31 when energized. The conveyor assembly 40 includes a continuous belt 41 in electrical communication with a conveyor motor 46 and a power source 60. In addition, the power source 60 may be electrically connected to the controller 50 and, indirectly, to the conveyor assembly 40, all of the electric and electronic components of the apparatus 10 as shown in FIG. 10. The conveyor assembly 40 may be coupled to inner surfaces of the housing 12 or may be supported by a framework (not shown). When energized, the continuous belt 41 has an outer surface operable to convey laundry downstream from an area proximate the washer drum 21 (that will be referred to as a first end 42) downstream to an area proximate the dryer drum 31 (that will be referred to as a second end 43). The conveyor assembly 40 may include a conveyor motor 46 that is electrically connected to the continuous belt 41 and operable to cause the continuous belt 41 to move in a downstream direction when energized, such as under the control of a controller 50, processor, or other electronics as will be described later. Further, the continuous belt 41 may include a plurality of fins 44 or ribs spaced apart along an upper surface of said continuous belt 41 that are operable to move the deposited laundry between the washer drum 21 and the dryer drum 31. Each fin 44 is oriented to extend transversely between opposed side edges of the continuous belt 41 (FIGS. 6-7).

The combination washing and drying apparatus 10 may include a plurality of activation controls 52 enabling a user to select and control operation of the apparatus. Critical to the present invention, however, is that a singular activation input switch (also referred to as an activation button 54) may be positioned on or proximate the top wall 16 of the housing 12 and electrically connected to the controller 50 or, alternatively, directly connected to the assemblies and motors described above, the activation button 54 being operable to initiate the washer drum 21 to perform a wash cycle, open the second washer sleeve 24, open the second dryer sleeve 34, and energize the continuous belt 41 at predetermined times so that a complete wash and dry cycle may be carried out according to the press of a single button as will be described in even further detail below.

The activation controls 52 and, specifically, the activation button 54, may be coupled to a controller 50 which, in turn, may be electrically connected or otherwise in data and control communication with the washer drum 21, dryer drum 31, conveyor assembly 40, and all related components described above (i.e. respective motors for each component) and necessary to carry out wash and dry cycles and conveyance of laundry between the washer and dryer drums, respectively. It is understood that functionality of the controller 50 may alternatively be accomplished with a processor under program and software control, with electronic components, or connections either with wires or wireless. The controller 50 is programmed or otherwise operable to execute process 100 to perform a wash and dry cycle with automatic conveyance of laundry between washer and dryer drums, respectively.

At step 102, the controller 50 determines if the wash/dry cycle has been activated, such as by determining if the actuation button has been pressed by a user. If the cycle has been activated, the process proceeds to step 104; otherwise, the controller 50 performs the check again and again until activation is detected. At step 104, the wash cycle is initiated, such as by energizing the washer motor 26 that causes the washer drum 21 (including water filling and draining and rotation) to perform a normal wash cycle. The process 100 then proceeds to step 106. At step 106, the controller determines if the wash cycle is complete and, if so, the process 100 proceeds to step 108; otherwise the process 100 cycles again at step 106.

At step 108, a signal is sent from the controller 50 to the washer drum 21 to cause the second washer sleeve 24 to move to the open configuration as described above. In other words, the second washer sleeve 24 is energized, as described above, to move to the open configuration so that any laundry there is deposited from the interior space of the washer drum 21 onto the first end of the continuous belt 41. The process 100 proceeds to step 110 in which case a signal is sent from the controller 50 to the dryer drum 31 to move the second dryer sleeve 34 to the open configuration as described above. In other words, the second dryer sleeve 34 is energized, as described above, to move to the open configuration so that any laundry conveyed by the continuous belt 41 automatically be deposited into the interior space of the dryer drum 31. Then, the process 100 proceeds to step 112, in which the controller 50 activates and energizes the continuous belt 41 to move—in this manner to move a load of laundry deposited on the continuous belt from the washer drum 21 to the dryer drum 31. Then, the process 100 causes the controller 50 to direct the second dryer sleeve 34 to close and, at step 118, the controller 50 directs to initiate a dryer cycle at step 118.

It is understood that while certain forms of this invention have been illustrated and described, it is not limited thereto except insofar as such limitations are included in the following claims and allowable functional equivalents thereof.

The invention claimed is:

1. A combination washing and drying apparatus for washing and then drying a load of clothing after a single actuation, comprising:

a housing having a bottom wall, a top wall substantially parallel to and upwardly displaced from said bottom wall, and a plurality of upstanding walls extending between said bottom wall and said top wall, said housing having a unitary and singular construction defining an interior area;

a washing assembly positioned in said interior area of said housing and that includes a washer drum having a first washer sleeve that has a cylindrical configuration defining an interior space for receiving the clothing into said interior area and defining a bottom opening and having a second washer sleeve that has a cylindrical configuration defining a washer aperture, said second washer sleeve being movable between a closed configuration at which said bottom opening and said washer aperture are offset such that said bottom opening is blocked by said second washer sleeve and an open configuration in which said bottom opening and said washer aperture are aligned for releasing the clothing from said interior space of said first washer sleeve;

a drying assembly positioned in said interior area of said housing and that includes a dryer drum having a first dryer sleeve that has a cylindrical configuration defining an interior space for receiving the clothing and defining a side opening and having a second dryer sleeve that has a cylindrical configuration defining a dryer side aperture, said second dryer sleeve being movable between a closed configuration at which said side opening and said dryer side aperture are offset such that said side opening is blocked by said second dryer sleeve and an open configuration in which said side opening and said dryer side aperture are aligned for receiving the clothing into said dryer drum; and a conveyor assembly mounted in said interior are and that includes a continuous belt having a first end adjacent said bottom opening of said first sleeve of said washer drum and a second end adjacent said side opening of said first sleeve of said dryer drum, said continuous belt being operably movable when energized;

wherein:

said conveyor assembly is positioned inside said interior area of said housing and includes a motor associated with said continuous belt for continuously moving said continuous belt when energized;

said continuous belt includes a plurality of fins spaced apart along an upper surface of said continuous belt operable to move the clothing between said washer drum and said dryer drum;

wherein said continuous belt is energized automatically when said second washer sleeve is moved to said open configuration, wherein said washer aperture is aligned with said bottom opening;

wherein said second dryer sleeve is operable to move automatically to said open configuration when said continuous belt is energized, wherein said side opening and said dryer side aperture are aligned;

an activation button mounted on said top wall of said housing a controller in electrical communication with said washer assembly, said drying assembly, said conveyor assembly, and said activation button;

wherein said controller is operable to:

energize said washer assembly to perform a wash cycle when said activation button is activated;

when said wash cycle is complete, actuate said second washer sleeve to move to said open configuration wherein said washer aperture is aligned with said bottom opening;

when said wash cycle is complete, energize said continuous belt of said conveyor assembly;

when said wash cycle is complete, actuate said second dryer sleeve to move to said open configuration wherein said dryer side aperture is aligned with said side opening.

2. The combination washing and drying apparatus as in claim 1, wherein:

said washing assembly includes a washer access door pivotally coupled to said washer drum that is movable between a closed configuration blocking access to said interior space of said washer drum and an open configuration allowing access to said interior space of said washer drum;

said drying assembly includes a dryer access door pivotally coupled to said dryer drum that is movable between a closed configuration blocking access to said interior space of said dryer drum and an open configuration allowing access to said interior space of said dryer drum.

3. The combination washing and drying apparatus as in claim 1, wherein:

said second washer sleeve is slidably coupled to and is positioned concentrically about said first washer sleeve for selectively moving between said closed configuration and said open configuration;

said second dryer sleeve is slidably coupled to and is positioned concentrically to said first dryer sleeve for selectively moving between said closed configuration and said open configuration.

* * * * *